US008174458B2

(12) United States Patent
Chou et al.

(10) Patent No.: US 8,174,458 B2
(45) Date of Patent: May 8, 2012

(54) DUAL-FEED ANTENNA

(75) Inventors: Jui-Hung Chou, Taichung (TW); Saou-Wen Su, Taipei (TW)

(73) Assignees: Silitek Electronics (Guangzhou) Co., Ltd., Guangzhou (CN); Lite-On Technology Corporation, Taipei (TW)

( * ) Notice: Subject to any disclaimer, the term of this patent is extended or adjusted under 35 U.S.C. 154(b) by 451 days.

(21) Appl. No.: 12/574,034

(22) Filed: Oct. 6, 2009

(65) Prior Publication Data

US 2010/0265151 A1 Oct. 21, 2010

(30) Foreign Application Priority Data

Apr. 16, 2009 (CN) ..... 2009 1 0038776

(51) Int. Cl.
*H01Q 5/00* (2006.01)
*H01Q 21/00* (2006.01)
*H01Q 1/48* (2006.01)

(52) U.S. Cl. ..... 343/843; 343/893; 343/846

(58) Field of Classification Search ..... 343/843, 343/893, 846, 702, 700 MS, 848, 829
See application file for complete search history.

(56) References Cited

U.S. PATENT DOCUMENTS

| | | | | |
|---|---|---|---|---|
| 6,448,932 | B1 | 9/2002 | Stoiljkovic et al. | |
| 6,542,123 | B1 * | 4/2003 | Chen | 343/700 MS |
| 6,970,137 | B1 * | 11/2005 | Maslovski et al. | 343/702 |
| 6,982,673 | B2 * | 1/2006 | Yuanzhu | 343/700 MS |
| 7,202,826 | B2 * | 4/2007 | Grant et al. | 343/713 |
| 7,482,978 | B2 * | 1/2009 | Yang et al. | 343/700 MS |
| 7,969,361 | B2 * | 6/2011 | Castaneda et al. | 343/700 MS |

FOREIGN PATENT DOCUMENTS

TW I255588 5/2006

* cited by examiner

*Primary Examiner* — Huedung Mancuso
(74) *Attorney, Agent, or Firm* — Rabin & Berdo, P.C.

(57) ABSTRACT

The invention relates to a dual-feed antenna. The dual-feed antenna includes a substrate, a first antenna unit and a second antenna unit. The second antenna unit includes a second radiating unit and a second grounding unit. The second radiating unit includes a second radiator which has a first groove. The first groove has a first bottom and a pair of first arms. The second grounding unit includes a first sub-grounding-area and a second sub-grounding-area. The second sub-grounding-area has a second groove which includes a second bottom and a pair of second arms. The first sub-grounding-area is cross-wise connected with the second sub-grounding-area at the bottom of the groove, and the second arms symmetrically distribute to both sides of the first sub-grounding-area, and the first groove has an opening direction opposite to the opening direction of the second groove.

20 Claims, 9 Drawing Sheets

DUAL-FEED ANTENNA

BACKGROUND OF THE INVENTION

1. Field of the Invention

The present invention is an apparatus which relates to an antenna and it's structure; especially, the present invention relates to a dual-band antenna structure encompassing two types of wireless local area network frequency bands.

2. Description of Related Art

Antennas are indispensible components for numerous wireless communication products and also play critical roles in contribution to effective reception of aired electromagnetic waves by the communication products. As wireless communication products, or devices and other consumer electronic products become more diverse, requirements imposed upon antenna design are increasingly more in demand than ever before. Each new profile design of the wireless product may require a new antenna design to provide good reception/emission performance, on the other hand, it also has to satisfy the electromagnetic waves of various wireless communication technologies. In this manner, the wireless product designs are constantly placing pressure upon, and necessarily driving the antenna technology to evolve toward the trends of wide-band and microminiaturization.

Booming development of wireless communication technologies rapidly raise the demands for antennas in the market, and current applications including, at least, mobile phones, notebook computers, Global Positioning Systems (GPS), digital TV's, Multiple Input Multiple Out (MIMO) and the like rely on the antenna for enabling signal emission and reception. The antenna is a required component in the wireless communication appliance for contact with external devices, which is integral in transmission and reception of wireless signals. Since the antenna is located at the foremost front of entire radio frequency system, the signal reception quality therein greatly affects operational performance of the whole wireless communication system. As demands from end users on commodity shape, power-saving and transmission speed and range becomes urgent, and requirements of antenna features in different application fields may also vary, so the antenna design inevitably faces even harsher technical challenges.

A conventional wireless local area network or 802.11a/b/g/n access point antenna is mostly composed of a dual-band access point antenna structure, in particular a Multiple Input Multiple Output (MIMO) antenna system. Such type of antenna system usually comprises a single-band 2.4 GHz or dual-band 2.4 GHz/5 GHz antenna, and since such a dual-band antenna has only one single feed, thus when applied to a dual-band or synchronous dual-band router, a switching circuit or duplex circuit needs to be additionally provided therein so as to effectively separate signals modulated in different frequency bands. With the addition of such a circuit, product costs may undesirably increase, which then may further negatively affect the character of the antenna itself, and as a result causing lowered bandwidth, gain, efficiency, and so forth.

Addressing the issues of inconvenience in use, requirements on installation of additional circuits found in the aforementioned dual-band access point antenna system, the disclosures of prior art U.S. Pat. No. I255588 and prior art U.S. Pat. No. 6,448,932 provide a dual-feed dual-band antenna structure designed with two-feed systems, thereby allowing convenient application in a dual-band or synchronous dual-band product without need for placing any additional circuit system therein, thus further saving product costs and demonstrating the optimal features of the antenna. However, in practice, the antenna structure consisting of the above-said relevant technologies requires a large grounding-area for commonly offering a grounding-area or alternatively the use of a plastic base so as to support the antenna, thus increasing the manufacturing outlay and complexity of the antenna. Additionally, since a grounding-area of large size is necessary, the volume of such type of antenna becomes large thereby preventing it from being widely used in various wireless communication products.

Consequently, with regard to the resolution of defects illustrated hereinbefore, the inventors of the present invention propose a reasonably designed solution for effectively eliminating such defects.

SUMMARY OF THE INVENTION

The objective of the present invention is to provide a dual-feed antenna characterized in small size, simple structure and reduced manufacture cost.

To achieve the objective described as above, the present invention discloses a dual-feed antenna, comprising: a substrate, consisting of a first surface and a second surface opposite to the first surface; a first antenna unit, consisting of a first radiating unit and a first grounding unit, which first radiating unit and first grounding unit are formed, respectively, on the same surface or the different surface of the substrate; and a second antenna unit, consisting of a second radiating unit and a second grounding unit, which second radiating unit and second grounding unit being respectively formed on the first surface and the second surface of the substrate, and which second grounding unit is in proximity of the first grounding unit. Herein, the second radiating unit includes a second radiator which has a first groove. The first groove has a first bottom and a pair of first arms. The second grounding unit consists of a first sub-grounding-area and a second sub-grounding-area. The second sub-grounding-area has a second groove which includes a second bottom and a pair of second arms. The first sub-grounding-area is crosswise connected with the second sub-grounding-area at the bottom of the groove, and the second arms symmetrically distributed to both sides of the first sub-grounding-area. The first groove has an opening direction opposite to the opening direction of the second groove. Preferably, the distance from the first arm to the second arm is approximately equal to one-half of the wavelength of a prescribed high frequency band.

The vertical distance from the first bottom to the free end of the first arm is defined as the length of the second radiator, the vertical distance from the second bottom to the free end of the second arm is defined as the length of the second sub-grounding-area, and the length of the second radiator is approximately equal to the length of the second sub-grounding-area.

The first groove may be a U-shaped groove, V-shaped groove, right angle U-shaped groove or arc-shaped groove.

The second groove may be a U-shaped groove, V-shaped groove, right angle U-shaped groove or arc-shaped groove.

The first sub-grounding-area may be rectangular, circular or elliptical, and the size of long side, diameter, or long axis thereof is greater than or equal to one-half the wavelength of a prescribed high frequency band.

The second radiating unit further consists of a microstrip transmission line, in which one end of the microstrip transmission line far from the second radiator is installed with a second feed point, and one end of the first sub-grounding-area close to the second feed point is installed with a second grounding-point.

The first radiating unit consists of a first radiator, the length of which first radiator being slightly smaller than one-quarter wavelength of a prescribed low frequency band.

The first radiator is sinuously installed on the first surface of the substrate, in which one end of the first radiator close to the first grounding unit is provided with a first feed point, which first feed point is out of the range covered or projected from the first grounding unit onto the substrate.

The first radiating unit further consists of a short circuit shred of inverse L shape connecting the first radiator and the first grounding unit.

The first grounding unit includes a first grounding-area and a first grounding-point, in which the first grounding-area may be rectangular, square, polygonal, circular or elliptical, and the size of long side, diameter or long axis thereof is approximately equal to one-quarter wavelength of a prescribed low frequency band, and the first grounding-point is installed near the end of the first grounding-area close to the first radiator.

The present invention provides the following beneficial effects: the dual-feed antenna, according to the present invention, can simultaneously generate a low frequency operation band and a high frequency operation band, and further, because of the dual-feed feature, it is not necessary to externally connect a switching circuit at the feed end of the antenna, thereby preventing undesirable degradation in antenna feature and satisfying the requirements for dual-module applications. Additionally, using experimental results, it can be proved that the dual-feed antenna according to the present invention demonstrates good electrical characteristics. Furthermore, since the dual-feed antenna according to the present invention needs only a metal plate of small size as the grounding-area, thereby providing the aspect of micro-miniaturization in integral volume, the dual-feed, antenna according to the present invention, is allowed to be more widely employed in the interior of the wireless product case. Additionally, the dual-feed antenna according to the present invention is also characterized in concise structure and modularization, fabrication processes thereof can be thus simplified, thereby resulting in reduced manufacturing costs.

In order to further appreciate the characteristics and technical contents of the present invention, references are hereunder made to the detailed descriptions and appended drawings in connection with the present invention. However, the appended drawings are merely shown for exemplary purposes, rather than being used to restrict the scope of the present invention.

DETAILED DESCRIPTION OF THE PREFERRED EMBODIMENTS

Figure 1:
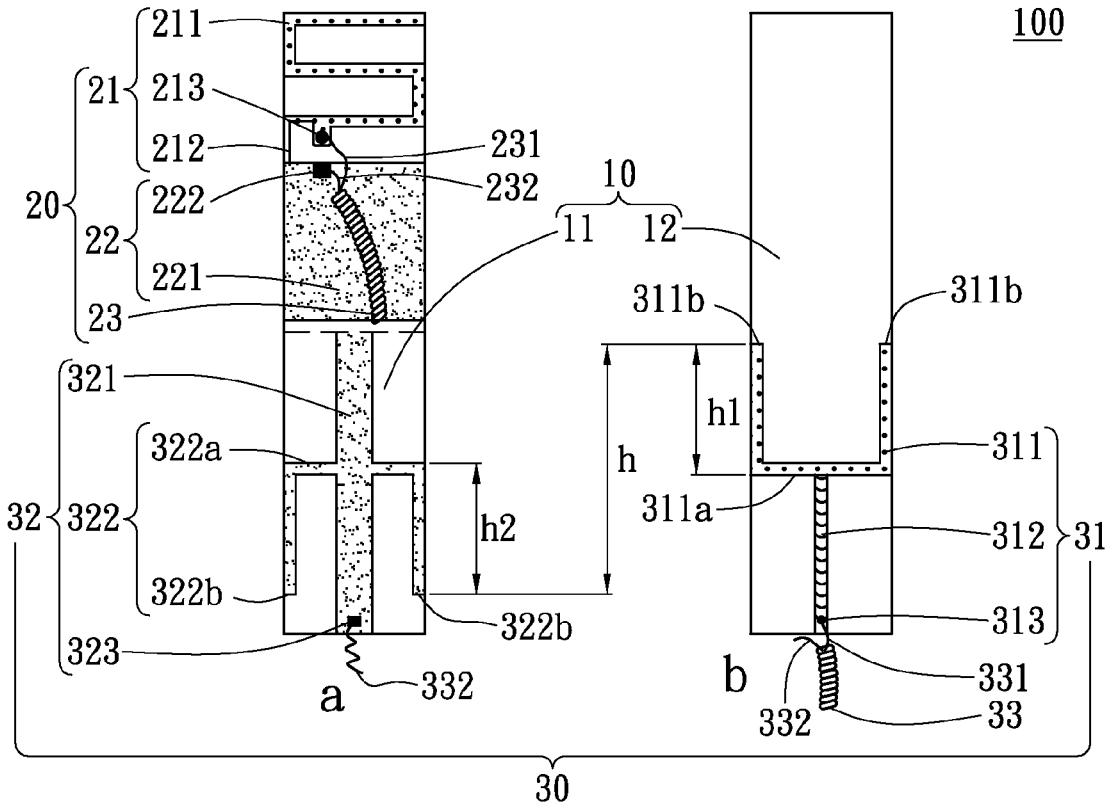
FIG. 1 is a structural diagram of the dual-feed antenna according to the first embodiment of the present invention.

Refer now to FIG. 1 comprising a Part (a) and Part (b), wherein the first preferred embodiment of the present invention provides a dual-feed antenna 100 consisting of a substrate 10 of long-bar shape, a first antenna unit 20 and a second antenna unit 30. The substrate has a first surface 11 and a second surface 12. The first antenna unit 20 is formed on the first surface 11 of the substrate 10 and the second antenna unit 30 is formed on the first surface 11 and the second surface 12 of the substrate 10. Part (a) of FIG. 1 indicates the distribution of partial components constituting the first antenna unit 20 and second antenna unit 30 (i.e., the second grounding unit 32) on the first surface 11 of the substrate 10, and Part (b) of FIG. 1 indicates the distribution of partial components constituting the second antenna unit 30 (i.e., the second radiating unit 31) on the second surface 12 of the substrate 10. The first antenna unit 20 consists of a first radiating unit 21 and a first grounding unit 22, in which the first radiating unit 21 and the first grounding unit 22 are both formed on the first surface 11 of the substrate 10, and the first antenna unit 20 is distributed in the upper half of the second surface 12 of the substrate 10. The second antenna unit 30 consists of a second radiating unit 31 and a second grounding unit 32, in which the second radiating unit 31 is formed in the lower half of the second surface 12 of the substrate 10, and the second grounding unit 32 which corresponds to the second radiating unit 31 is formed in the lower half of the first surface 11 of the substrate 10. The second grounding unit 32 is in proximity of the first grounding unit 22, and the second grounding unit 32, the first grounding unit 22 as well as the first radiating unit 21 are sequentially arranged in a bottom-up fashion along the length direction of the substrate 10.

As shown in Part (a) of FIG. 1, the first radiating unit 21 further consists of a first radiator 211, a short circuit shred 212 and a first feed point 213. The first grounding unit 22 further consists of a first grounding-area 221 and a first grounding-point 222. The first feed point 213 is out of the range covered or projected from the first grounding unit 22 onto the substrate 10. The first radiator 211 is sinuously installed on one end of the substrate 10, and the L-shaped short circuit shred 212 connects the first radiator 211 and the first grounding-area 221. The first antenna unit 20 further consists of a coaxial transmission line 23, which coaxial transmission line 23 coupling the first radiating unit 21 and the first grounding unit 22. In one practical embodiment, the coaxial transmission line 23 may have a central conductor 231 and an outer layer grounding conductor 232, wherein the central conductor 231 is electrically connected to the first feed point 213 and the outer layer grounding conductor 232 is electrically connected to the first grounding-point 222.

In combination of Part (a) and Part (b) in FIG. 1, the second radiating unit 31 consists of a second radiator 311, a microstrip transmission line 312 and a second feed point 313. The second grounding unit 32 includes a first sub-grounding-area 321, a second sub-grounding-area 322 and a second grounding-point 323. The second antenna unit 30 also consists of a coaxial transmission line 33 coupling the second radiating unit 31 and second grounding unit 32. In one practical embodiment, the coaxial transmission line 33 has a central conductor 331 and an outer layer grounding conductor 332, in which the central conductor 331 is electrically connected to the second feed point 313 and the outer layer grounding conductor 332 is electrically connected to the second grounding-point 323.

The second radiator 311 is a first groove of right angle U shape, which first groove being open upward (i.e., toward the first antenna unit 20). The first groove has a first bottom 311*a* and a pair of first arms 311*b*, and the vertical distance from the first bottom 311*a* to the free end of the first arms 311*b* is defined as the length of the second radiator 311, indicated by h1. The microstrip transmission line 312 extends from the first bottom 311*a* downward (i.e., the direction departing from the first antenna unit 20) to the other end of the substrate 10, and the second feed point 313 is arranged on one end of the microstrip transmission line 312 remote from the first bottom 311*a*.

The second sub-grounding-area 322 is a second groove of an inverse right angle U shape, which second groove being open backward to the first antenna unit 20. The second groove has a second bottom 322*a* and a pair of second arms 322*b*, and the vertical distance from the first bottom 322*a* to the free end of the first arms 322*b* is defined as the length of the second sub-grounding-area 322, indicated by h2. The first sub-grounding-area 321 is cross-wise connected with the second sub-grounding-area 322 at the bottom 322*a* of the groove, the pair of second arms 322*b* symmetrically distribute to both sides of the first sub-grounding-area 321, and the second grounding-point 323 is arranged on one end of the first sub-grounding-area 321 remote from the first antenna unit 20.

The length h1 of the second radiator 311 is approximately equal to the length h2 of the second sub-grounding-area 322. The first bottom 311*a* and the second bottom 322*a* are optimally located at the same horizontal location on the substrate 10 (whereas respectively placed on the first surface 11 and the second surface 12); in other word, the first bottom 311*a* and the second bottom 322*a* are in an overlapped pattern with the substrate 10 arranged therein between. On the other hand, the first bottom 311*a* and the second bottom 322*a* may be possibly not overlapped, but in such a case, the second radiator 311 and the second sub-grounding-area 322 should be installed in a mutually departing fashion (that is, both of them extend in an mutually opposite direction), instead of being cross-wise arranged. As they are configured in such a mutually departing fashion, then the first bottom 311*a* and the second bottom 322*a* essentially should be placed as closely as possible. Consequently, as shown in FIG. 1, the vertical distance h from the free end of the first arm 311*b* to the free end of the second arm 322*b* is approximately equal to the sum of the length of the second radiator 311 (h1) and the length of the second sub-grounding-area 322 (h2). In addition, the length of the first sub-grounding-area 321 is not smaller than the vertical distance h from the free end of the first arm 311*b* to the free end of the second arm, so the length of the first sub-grounding-area 321 can be deemed as the length of the second antenna unit 30 which is not smaller than the sum of the length of the second radiator 311 (h1) and the length of the second sub-grounding-area 322 (h2).

The first antenna unit 20 and the second antenna unit 30 are used to generate the first frequency band and the second frequency band, wherein the first frequency band and the second frequency band may be different operation bands, or alternatively the identical operation bands. In the present embodiment, the first frequency band and the second frequency band can respectively cover the required wideband bandwidths for a low frequency band of an indoor wireless local area network (such as 2400~2484 MHz) and a high frequency band of the wireless local area network (such as 5150~5875 MHz). To satisfy such a condition, the length of the first radiator 211 in the first antenna unit 20 (i.e., the total length of the naturally extended first radiator 211) should be designed as slightly smaller than one-quarter wavelength of the low frequency band, and the length of the first grounding-area 221 should be approximately equal to one-quarter wavelength of the low frequency band; the vertical distance h from the free end of the first arm 311*b* of the second radiator 311 in the second antenna unit 30 to the free end of the second arm 322*b* is approximately equal to one-half wavelength of the high frequency band, and the length of the first sub-grounding-area 321 in the second antenna unit 30 is not smaller than (i.e., greater than or equal to) one-half wavelength of the high frequency band.

The dual-feed antenna 100 is not subject to the requirement on a grounding-area of large size for antenna radiation, thereby reducing the integral volume of the antenna, so providing advantages of simple structure, convenient fabrication process and reduced manufacture cost.

Certainly, the structure of the dual-feed antenna 100 can be implemented in various ways, and hereunder in conjunction with FIGS. 2 to 13, the practical structure of the dual-feed antenna 100 according to other embodiments of the present invention is respectively illustrated.

Figure 2:
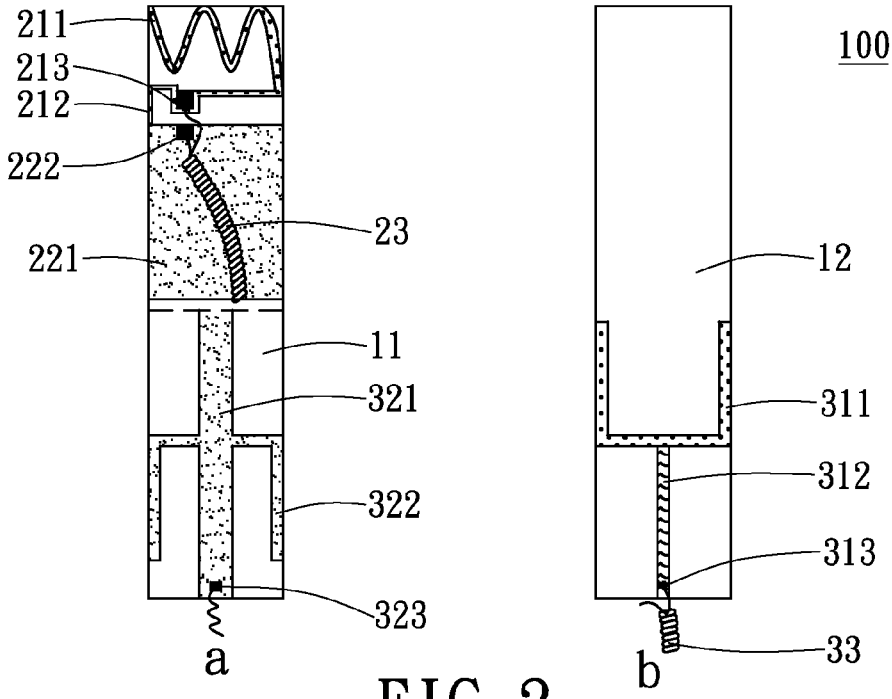
FIG. 2 is a structural diagram of the dual-feed antenna according to the second embodiment of the present invention.
Figure 3:
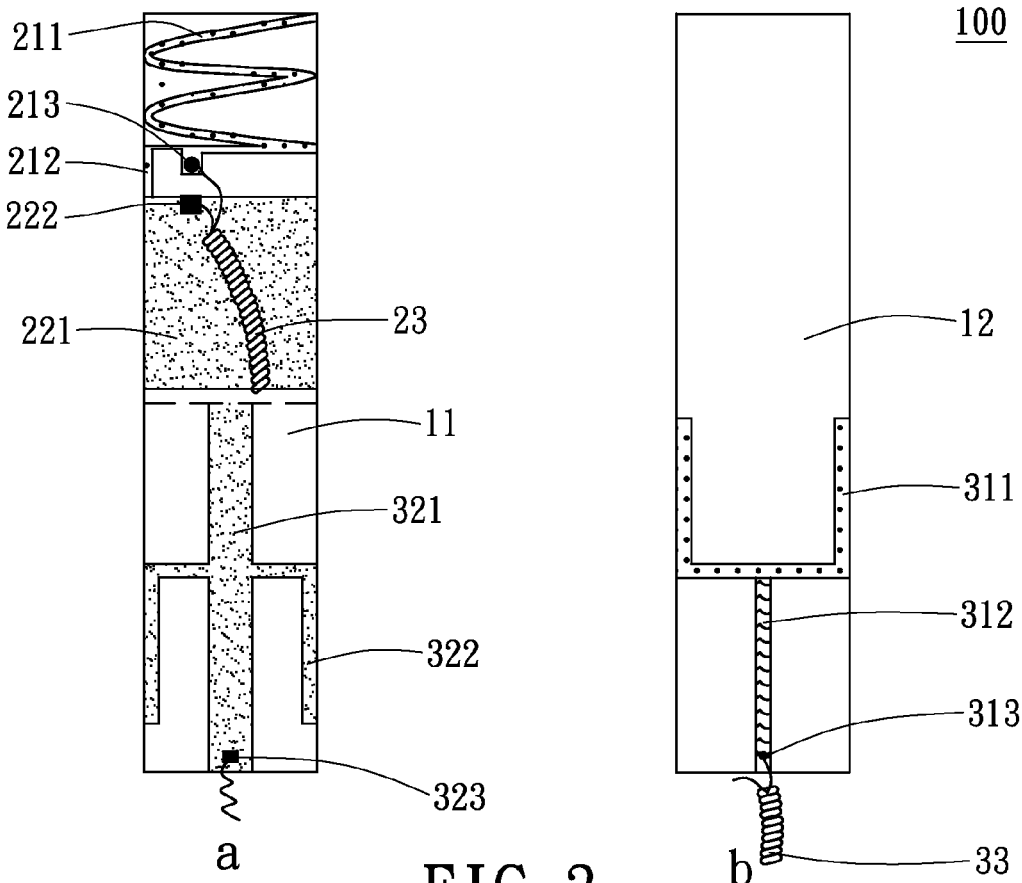
FIG. 3 is a structural diagram of the dual-feed antenna according to the third embodiment of the present invention.

As shown in FIG. 2, a dual-feed antenna 100 according to the second embodiment of the present invention is provided, wherein the first radiator 211 of the first antenna unit 20 is sinuously installed on one end of the substrate 10 in a fashion different from the first embodiment. Similarly, as shown in FIG. 3, a dual-feed antenna 100 according to the third embodiment of the present invention is provided, wherein the first radiator 211 of the first antenna unit 20 is sinuously installed on one end of the substrate 10 in a yet different fashion. In the aforementioned three embodiments, the naturally extended lengths of the first radiators 211 are identical, and preferably slightly smaller than one-quarter wavelength of the low frequency band, but the first radiator 211 may be sinuously placed in different fashions, so long as it is installed on one end of the substrate 10 and takes less length on the end of the substrate 10 as mush as possible, thereby decreasing the total length of the first antenna unit 20, thus further reducing the volume of the dual-feed antenna 100. Herein Part (a) in FIG. 2 and FIG. 3 both indicates the antenna structure installed on the first surface 11 of the substrate 10 and Part (b) indicates the antenna structure installed on the second surface 12 of the substrate 10, whereas the rest parts of such implementations may be referred to the first embodiment which are omitted for brevity.

Figure 4:
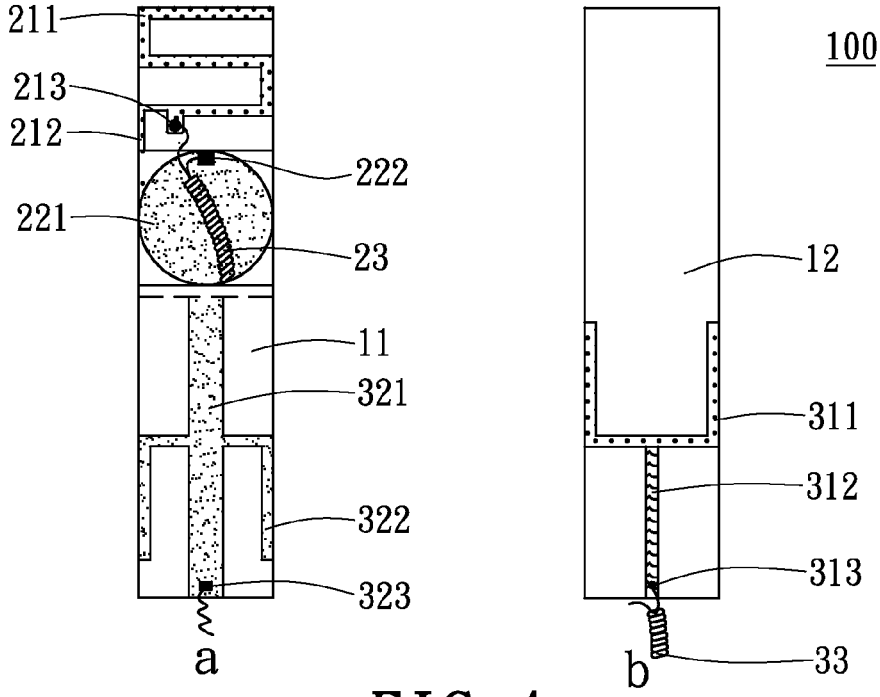
FIG. 4 is a structural diagram of the dual-feed antenna according to the fourth embodiment of the present invention.
Figure 5:
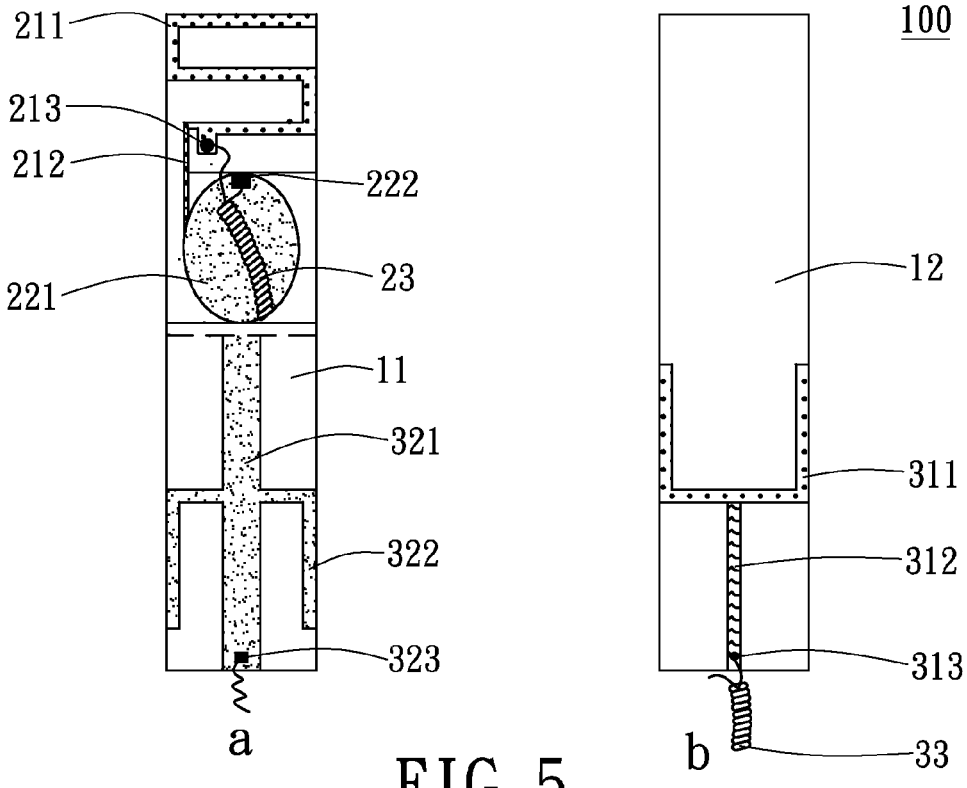
FIG. 5 is a structural diagram of the dual-feed antenna according to the fifth embodiment of the present invention.
Figure 6:
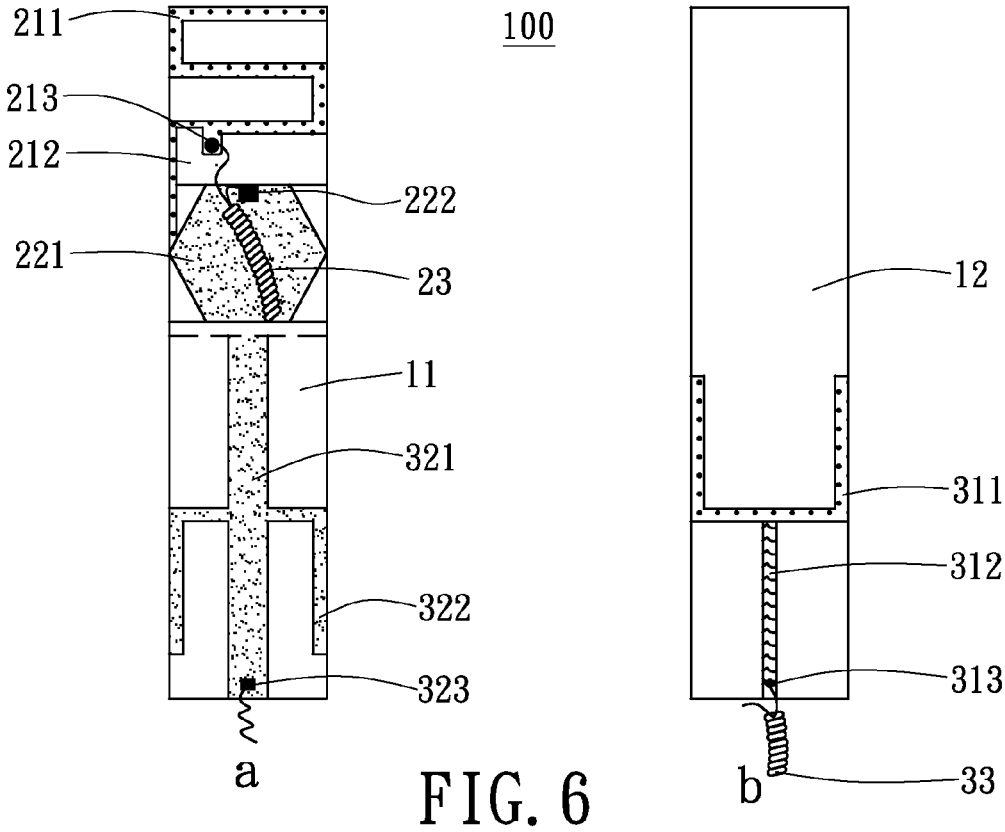
FIG. 6 is a structural diagram of the dual-feed antenna according to the sixth embodiment of the present invention.

As shown in FIGS. 4 to 6, a dual-feed antenna 100 according to the fourth to sixth embodiments of the present invention is provided, wherein the first grounding-area 221 in the first antenna unit 20 is respectively circular, elliptic and right hexagonal, and the rest components and structures thereof are identical to the first embodiment. The fourth to sixth embodiments illustrate that, in the dual-feed antenna 100 according to the present invention, the first grounding-area 221 in the first antenna unit 20 may be of various shape, e.g., polygonal, circular, elliptic, rather than being limited to what is shown in such embodiments, so long as the condition that the size thereof along the length direction is approximately equal to one-quarter wavelength of the low frequency band is satisfied; in other word, as long as the requirement that the long side of the polygon, the diameter of the circle or the long axis of the ellipse is approximately equal to one-quarter wavelength of the prescribed low frequency band is fulfilled. Herein Part (a) in FIG. 4 to FIG. 6 indicates the antenna structure installed on the first surface 11 of the substrate 10, and Part (b) indicates the antenna structure installed on the second surface 12 of the substrate 10.

Figure 7:
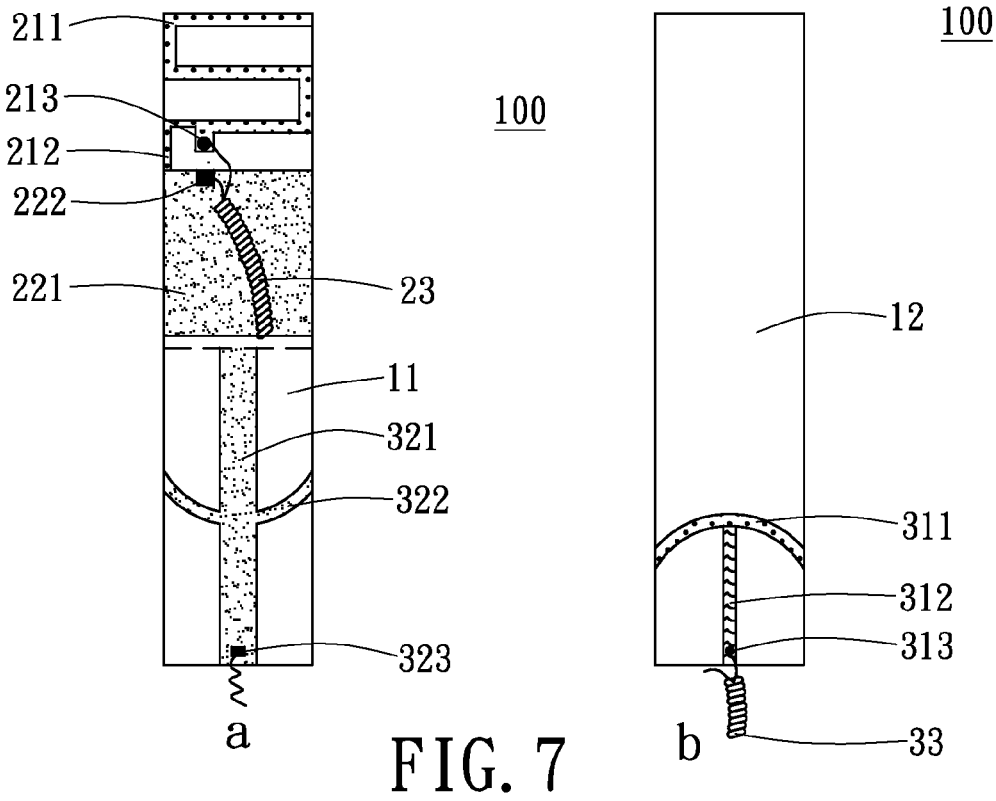
FIG. 7 is a structural diagram of the dual-feed antenna according to the seventh embodiment of the present invention.
Figure 8:
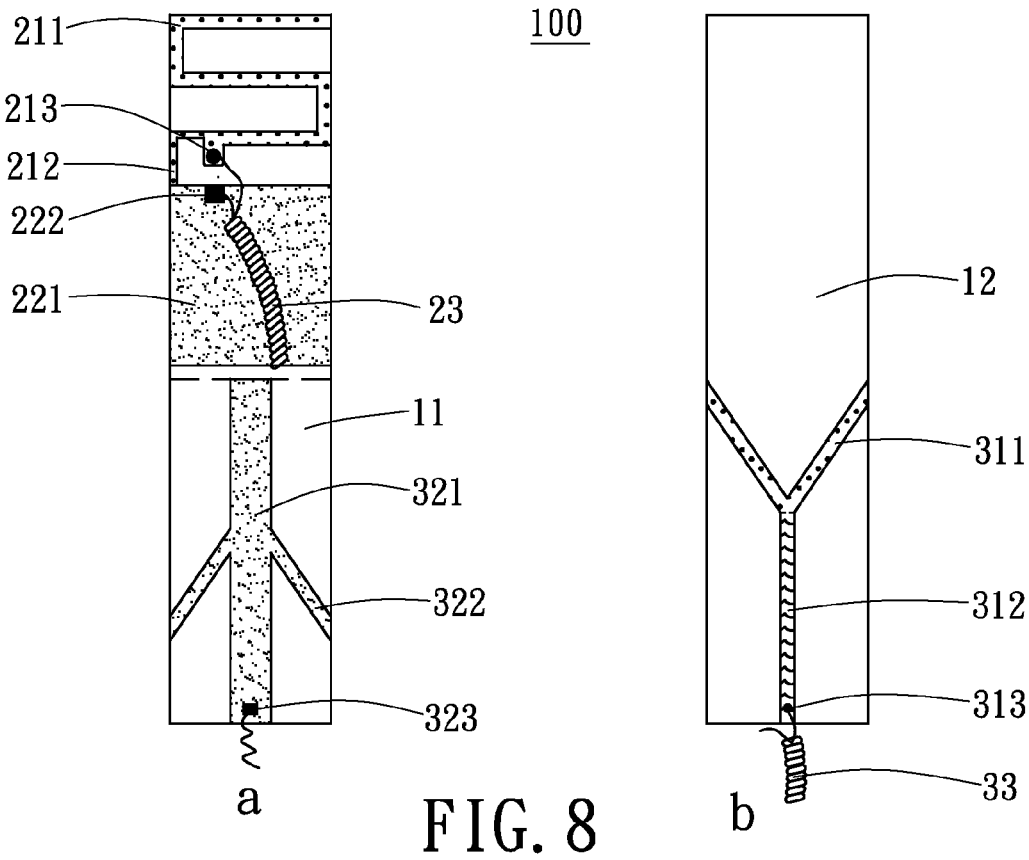
FIG. 8 is a structural diagram of the dual-feed antenna according to the eighth embodiment of the present invention.

As shown in FIG. 7 and FIG. 8, a dual-feed antenna 100 according to the seventh to eighth embodiments of the present invention is provided, wherein the second radiator 311 in the second antenna unit 30 and the second sub-grounding-area 322 have shapes different from the right angle U shape illustrated in the first embodiment, but being respectively an arc-shaped groove and a V-shaped groove, whereas the rest components and structures thereof are identical to the first embodiment. Additionally, as shown in FIG. 7, the groove opening direction of the second radiator 311 is different from the first embodiment, which is open downward, while the groove opening direction of the second sub-grounding-area 322 has an upward opening direction. From these two embodiments, it can be seen that the groove shapes of the second radiator 311 in the second antenna unit 30 and the second sub-grounding-area 322 may vary differently, rather than being limited to illustrated right angle U groove shape, arc groove shape and V groove shape, so long as the opening direction is opposite, and the distance from the free end of the arm in the second radiator 311 to the free end of the arm in the second sub-grounding-area 322 (which distance being as calculated according to the texts illustrated in the first embodiment) is approximate equal to the one-half wavelength of the high frequency band. Herein Part (a) in FIG. 7 to FIG. 8 indicates the antenna structure installed on the first surface 11 of the substrate 10, and Part (b) indicates the antenna structure installed on the second surface 12 of the substrate 10.

Figure 9:
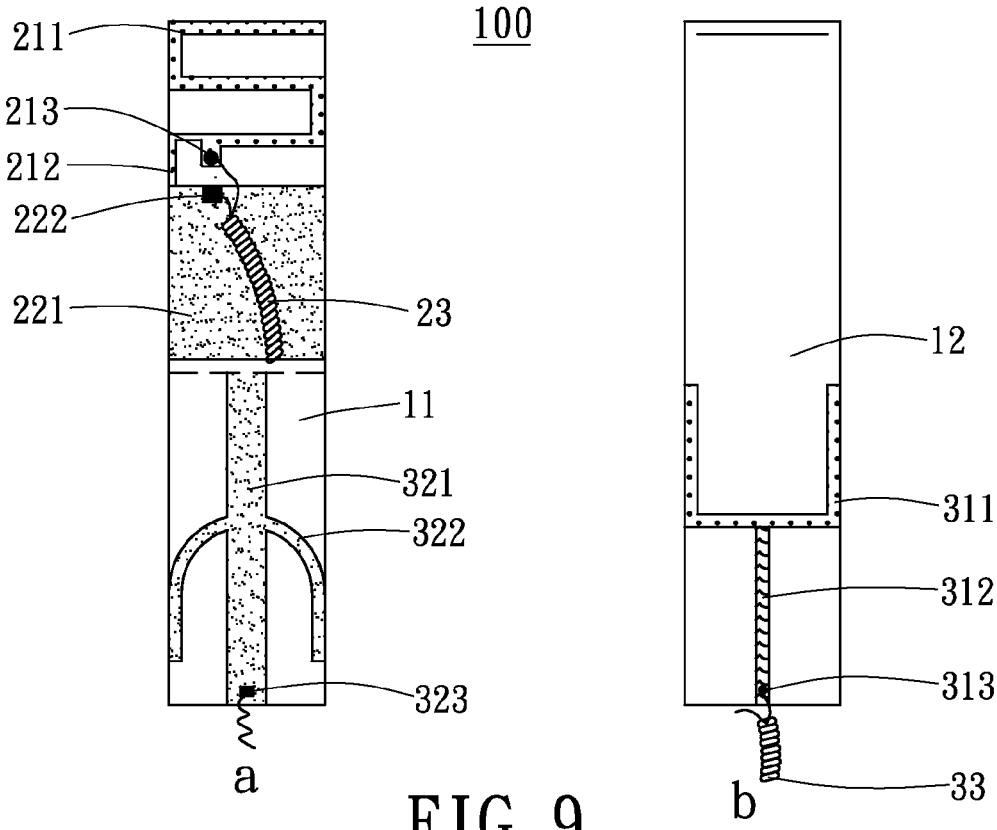
FIG. 9 is a structural diagram of the dual-feed antenna according to the ninth embodiment of the present invention.

As shown in FIG. 9, a dual-feed antenna 100 according to the ninth embodiment of the present invention is provided, wherein the second sub-grounding-area 322 in the second antenna unit 30 is a U-shape groove, while other components are identical to the first embodiment. In addition to the variety of groove shapes for the second radiator 311 in the second antenna unit 30 and the second sub-grounding-area 322, the ninth embodiment also describes that the groove shapes for the second radiator 311 and the second sub-grounding-area 322 can be mutually different, e.g., one may be U-shaped, while the other is right angle U-shaped.

Figure 10:
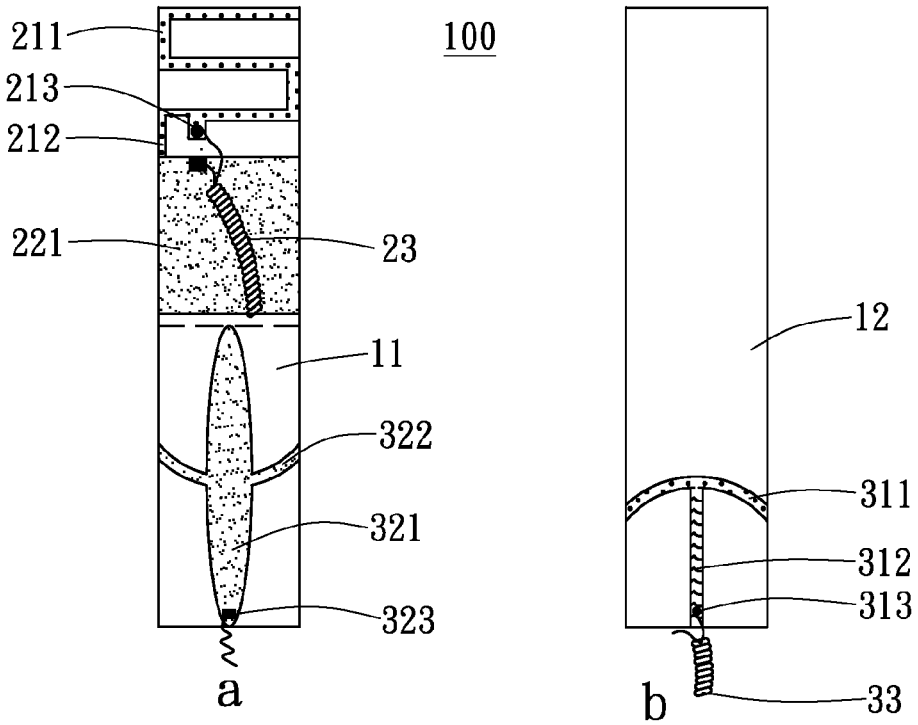
FIG. 10 is a structural diagram of the dual-feed antenna according to the tenth embodiment of the present invention.

As shown in FIG. 10, a dual-feed antenna 100 according to the tenth embodiment of the present invention is provided, wherein the shape of the first sub-ground-area 321 in the second antenna unit 30 is elliptic, instead of the long-bar shape as illustrated in the aforementioned nine embodiments, while other components are identical to the seventh embodiment. The present embodiment shows that the shape of the first sub-ground-area 321 in the second antenna unit 30 can vary differently, rather than being limited to long-bar, ellipse etc. That is, the first sub-ground-area 321 may be rectangular, circular or elliptic, so long as the long side of the rectangle, the diameter of the circle or the long axis of the ellipse is greater than or equal to one-half wavelength of a prescribed high frequency band.

Figure 11:
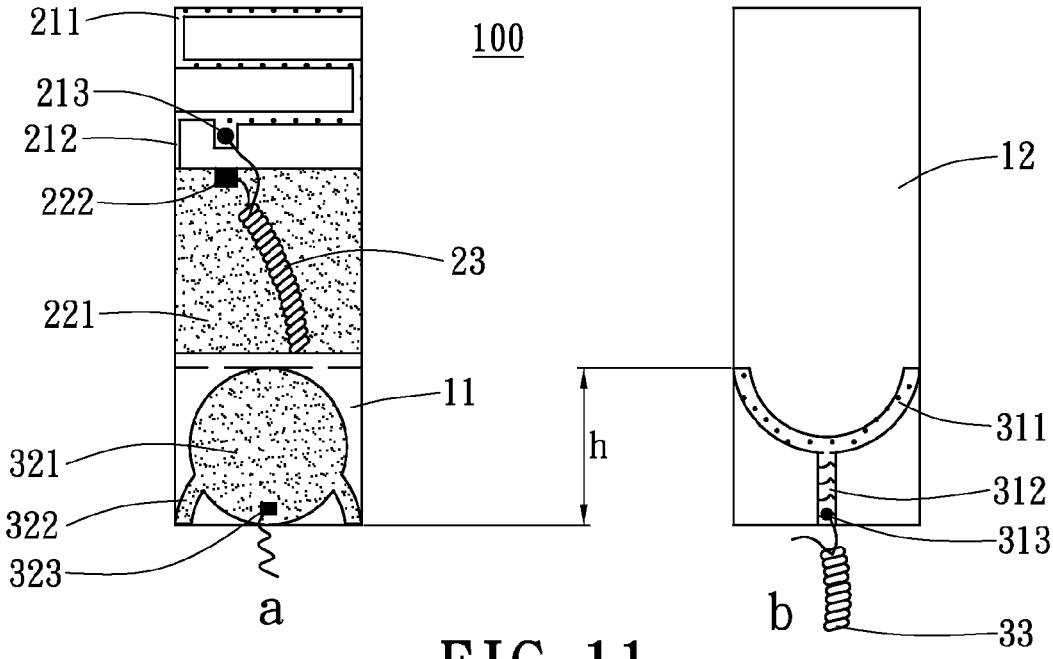
FIG. 11 is a structural diagram of the dual-feed antenna according to the eleventh embodiment of the present invention.

As shown in FIG. 11, a dual-feed antenna 100 according to the eleventh embodiment of the present invention is provided, wherein the shape of the first sub-grounding-area 321 in the second antenna unit 30 is circular, the second sub-grounding-area 322 is an arc-shaped groove with a downward opening, the second radiator 311 is an arc-shaped groove with an upward opening, and other components are the same as the first embodiment. It should be noted that the distance h from the free end of the arm in the second radiator 311 to the free end of the arm in the second sub-grounding-area 322 is equal to the diameter of the first sub-grounding-area 321, which is different from the other embodiments where the size of the first sub-grounding-area 321 in the length direction is always greater than the distance h from the free end of the arm in the second radiator 311 to the opening end of the groove in the second sub-grounding-area 322. Therefore, in addition to the fact that the shape of the first sub-grounding-area 321 is not limited to long-bar shape and ellipse, the present embodiment also explains that the length size of the first sub-grounding-area 321 can be equal to the distance h from the bottom of the second radiator 311 to the groove opening end of the second sub-grounding-area 322, and when the length size of the first sub-grounding-area 321 is equal to the distance h from the free end of the arm in the second radiator 311 to the free end of the arm in the second sub-grounding-area 322, the size of the second antenna unit 30 is minimized. Herein Part (a) in FIG. 9 to FIG. 11 indicates the antenna structure installed on the first surface 11 of the substrate 10, and Part (b) indicates the antenna structure installed on the second surface 12 of the substrate 10.

Figure 12:
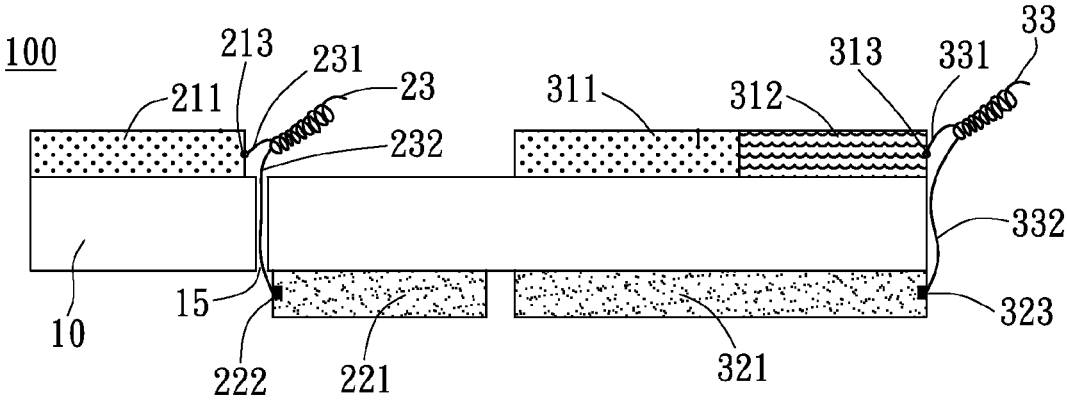
FIG. 12 is a structural diagram in lateral view of the dual-feed antenna according to the twelfth embodiment of the present invention.
Figure 13:
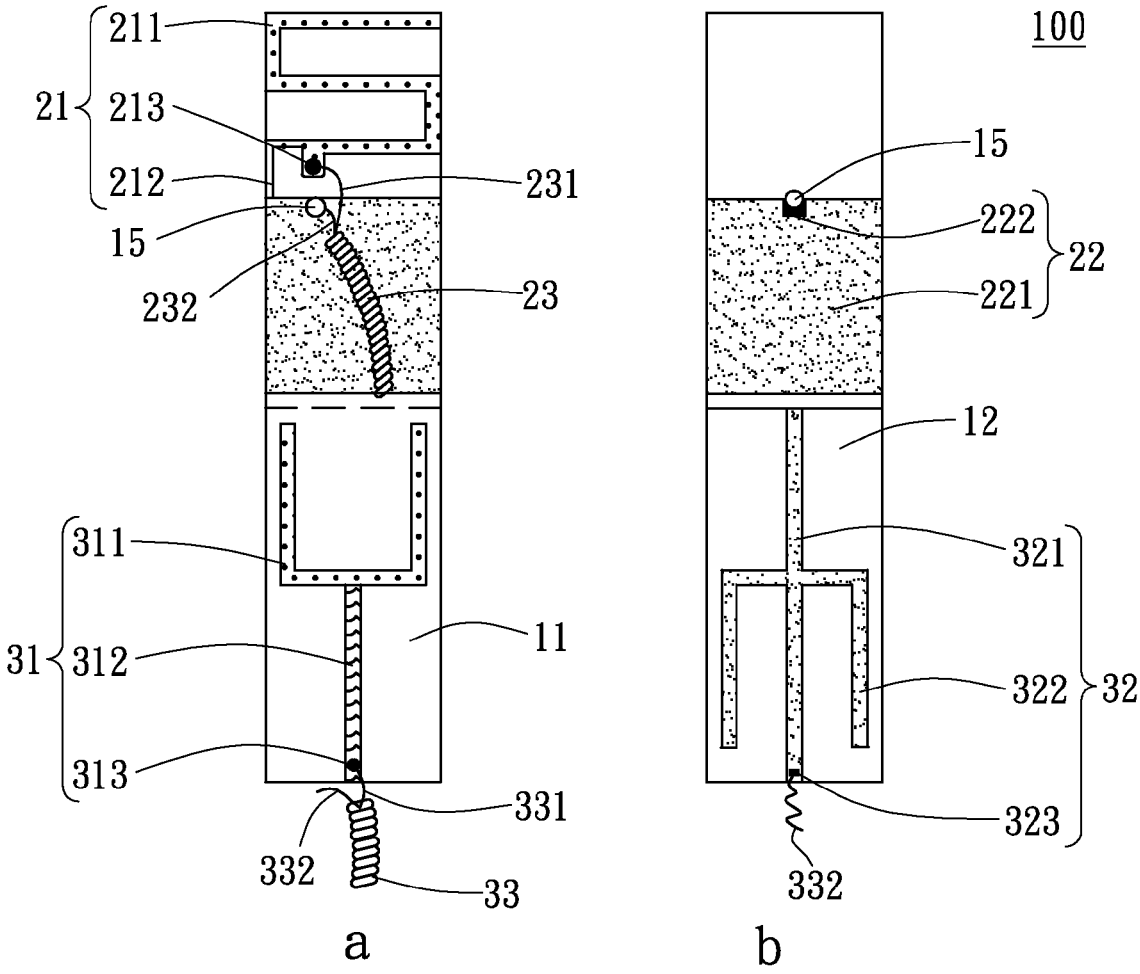
FIG. 13 is a structural diagram in both front and rear views of the dual-feed antenna according to the twelfth embodiment of the present invention.

Conjunctively referring to FIG. 12 and FIG. 13, a dual-feed antenna 100 according to the twelfth embodiment of the present invention is provided, wherein the components and structures thereof are essentially identical to the first embodiment with the following differences: the first radiating unit 21 and the first grounding unit 22 of the first antenna unit 20 is respectively formed on the first surface 11 and the second surface 12 of the substrate 10; that is, unlike other aforementioned embodiments, the first radiating unit 21 and the first grounding unit 22 herein are formed on two different surfaces. Besides, the second radiating unit 31 of the second antenna unit 30 is formed on the first surface 11 that is the same surface of the substrate 10 on which the first radiating unit 21 is formed; meanwhile, the second grounding unit 32 of the second antenna unit 30 is formed on the second surface 12 that is the same surface of the substrate 10 on which the first grounding unit 22 is formed. In order to couple the first radiating unit 21 and the first grounding unit 22, a hole 15 is provided on the substrate 10, and the outer layer grounding conductor 232 of the coaxial transmission line 23 passes through the hole 15 to electrically connect to the first grounding-point 222. The present embodiment illustrates that the first radiating unit 21 and the first grounding unit 22 of the first antenna unit 20 can be optionally installed on different surfaces of the substrate 10, as desired, rather than being limited to the same surface of the substrate 10. Herein Part (a) in FIG. 13 indicates the antenna structure installed on the first surface 11 of the substrate 10, and Part (b) indicates the antenna structure installed on the second surface 12 of the substrate 10.

In the following texts, the dual-feed antenna shown in the first embodiment will be referred conjunctively with FIG. 14 to FIG. 17, so as to demonstrate the performance of the dual-feed antenna according to the present invention measured in courses of antenna experiments.

Figure 14:
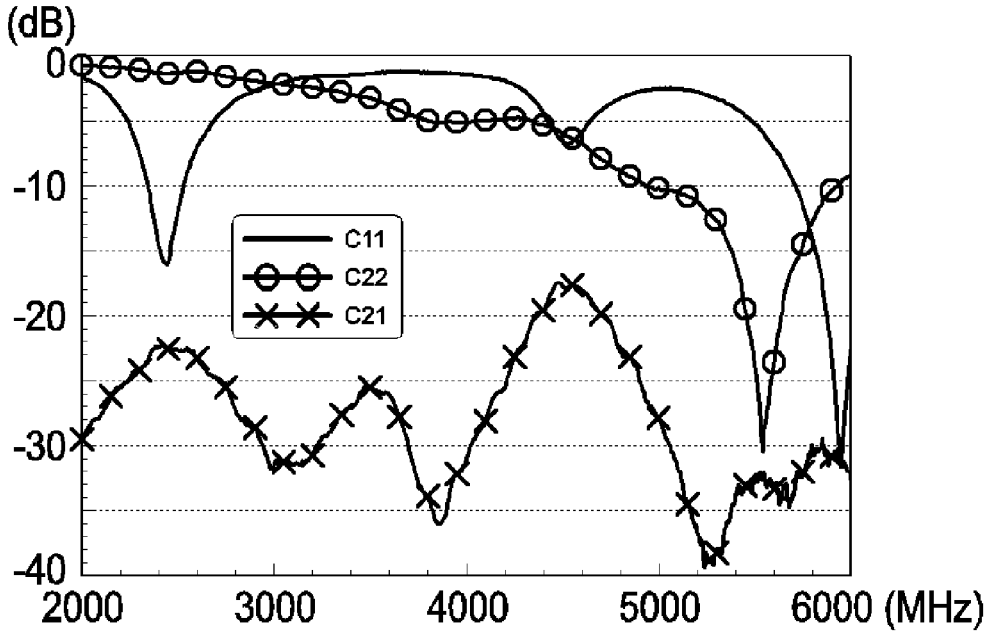
FIG. 14 is a diagram showing measurement results of reflection coefficient and isolation in the dual-feed antenna according to the first embodiment of the present invention.

Refer now to FIG. 14, a diagram showing measurement results of reflection coefficient and isolation in the dual-feed antenna 100 according to the first embodiment of the present invention. Herein the curve of return loss C11 indicates the performance of the dual-feed antenna 100 at the low frequency range, and the curve of return loss C22 indicates the performance of the dual-feed antenna 100 at the high frequency range, while the curve of isolation C21 represents the interference between the two frequencies. Typically, a feature of antenna impedance bandwidth under −10 dB may provide better transmission quality. It can be seen from FIG. 14 that curve C11 of the dual-feed antenna 100 satisfies 2400~2484 MHz operation band under the definition of being smaller than −10 dB impedance bandwidth; similarly, curve C22 also meets the condition of being smaller than −10 dB at 5150~5875 MHz. On the other hand, curve C21 is smaller than −20 dB at both high frequency band and low frequency band, indicating these two bands present good isolation result which effectively prevents the occurrence of interference in operation.

Figure 15:
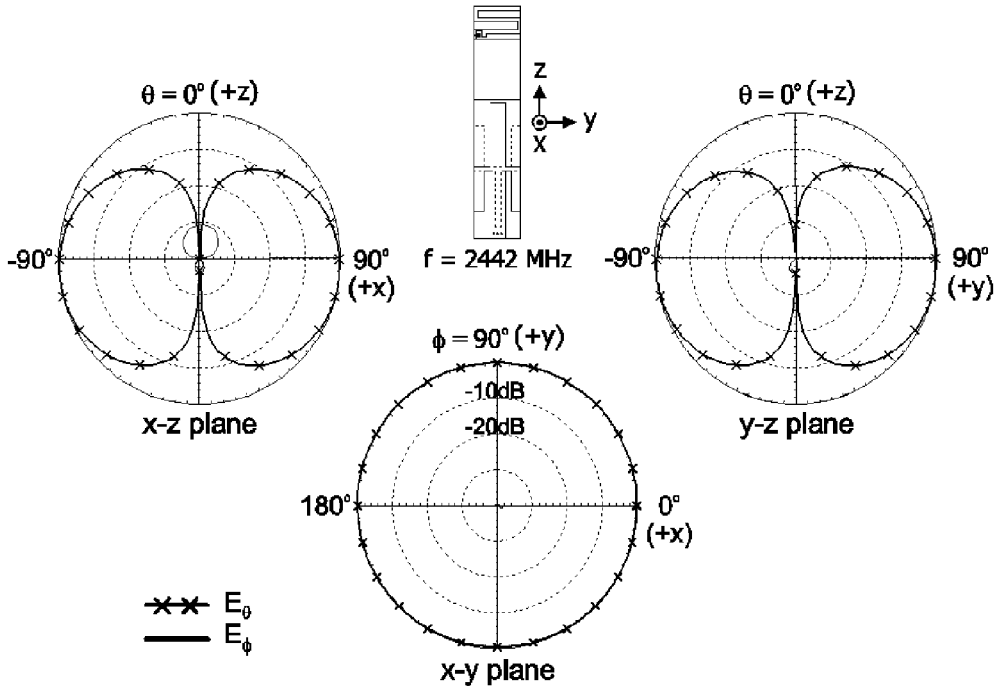
FIG. 15 is a two dimensional radiation diagram of the dual-feed antenna according to the first embodiment of the present invention at 2442 MHz.

Refer next to FIG. 15, wherein a two dimensional radiation diagram depicting the first antenna unit 20 of the dual-feed antenna 100 according to the first embodiment of the present invention excited at 2442 MHz is shown. From the radiation field patterns on X-Y plane, X-Z plane and Y-Z plane, it can be observed that the radiation field pattern of the dual-feed antenna 100 at 2442 MHz is a good omni-directional radiation field pattern on X-Y plane which allows fulfillment of the application demands regarding to general wireless local area network operations.

Figure 16:
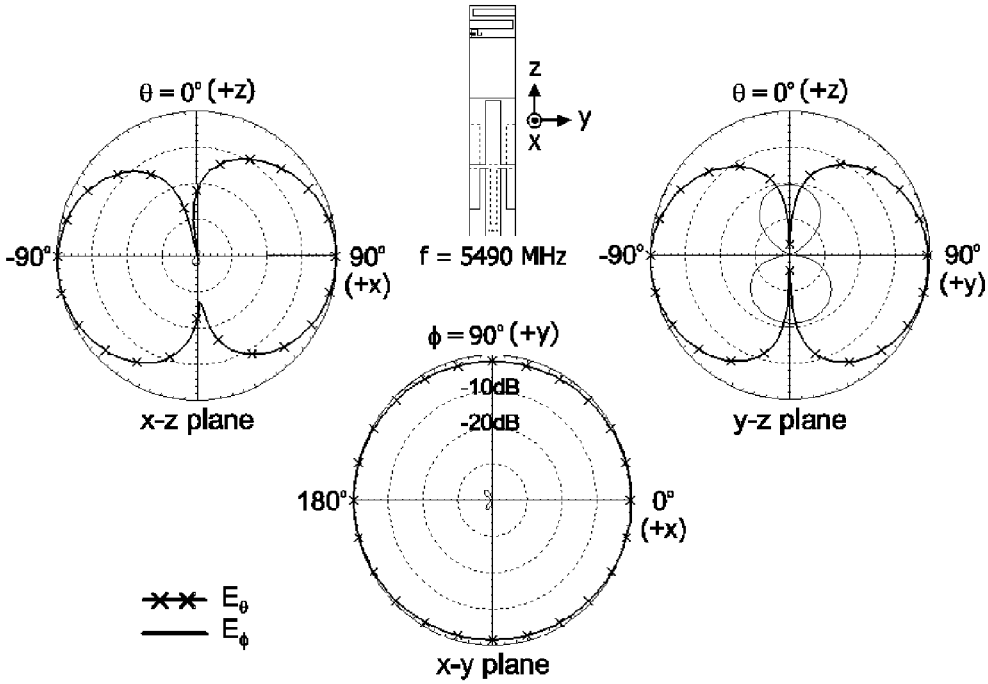
FIG. 16 is a two dimensional radiation diagram of the dual-feed antenna according to the first embodiment of the present invention at 5490 MHz.

Refer further to FIG. 16, wherein a two dimensional radiation diagram depicting the second antenna unit 30 of the dual-feed antenna 100 according to the first embodiment of the present invention excited at 5490 MHz is shown. From the radiation field patterns on X-Y plane, X-Z plane and Y-Z plane, it can be observed that the radiation field pattern of the dual-feed antenna 100 at 5490 MHz is a good omni-directional radiation field pattern on X-Y plane which also allows fulfillment of the application demands regarding to general wireless local area network operations.

Figure 17:
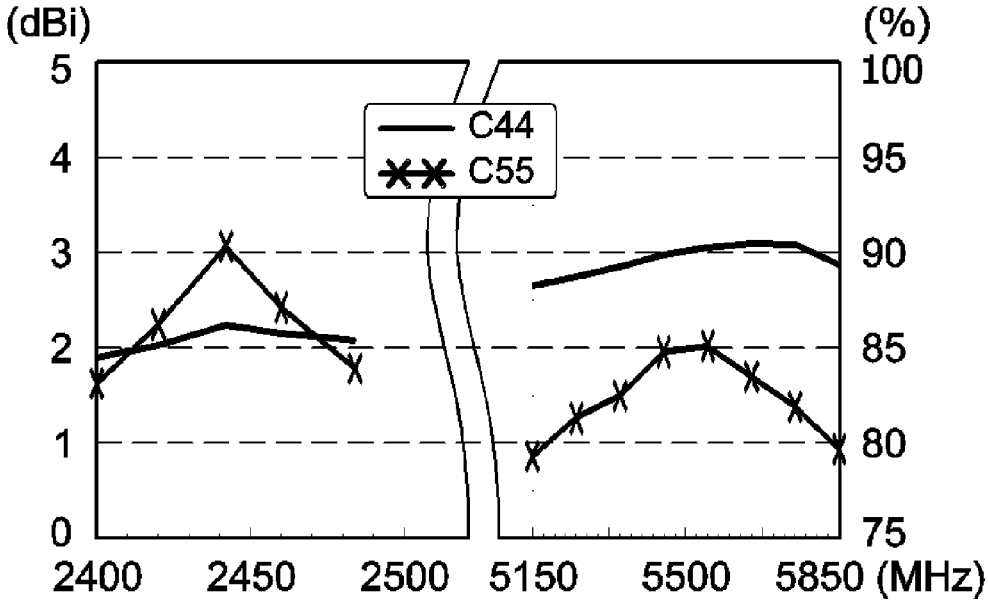
FIG. 17 is a diagram showing experimental curves of antenna gain and radiation efficiency in the dual-feed antenna according to the first embodiment of the present invention.

Refer now to FIG. 17, a diagram showing experimental curves of antenna gain and radiation efficiency in the dual-feed antenna 100 according to the first embodiment of the present invention. Herein C44 is a curve of antenna gain, indicating the gain acquired for the antenna; C55 is a curve of radiation efficiency, indicating the radiation efficiency created by the antenna. From these experimental curves, it can be found that the gains of the dual-feed antenna 100 obtained at such low and high frequency bands are both greater than 2 dBi, with radiation efficiencies thereof greater than 80%. Therefore, the dual-feed antenna 100 is capable of matching the requirements for signal transmissions at both low and high frequency bands.

In summary of aforementioned descriptions, the present invention can provide the following advantages:

1. the dual-feed antenna 100 disclosed in the present invention can simultaneously generate a low frequency operation band and a high frequency operation band, and further because of the dual-feed feature, it needs not to externally connect a switching circuit at the feed end of the antenna, thereby preventing undesirable degradation in antenna feature and satisfying the requirements on dual-module applications;

2. the dual-feed antenna 100 according to the present invention needs only a metal plate of small size as the grounding-area, accordingly providing the aspect of microminiaturization in integral volume, allowing the dual-feed antenna 100 according to the present invention to be more widely employed in the interior of the wireless product case;

3. the dual-feed antenna 100 according to the present invention is characterized in concise structure and modularization, fabrication processes thereof can be thus simplified, thereby resulting in reduced manufacture costs.

The texts set forth hereinbefore illustrate simply the preferred embodiments of the present invention, rather than intending to restrict the scope of the present invention claimed to be legally protected thereto. All effectively equivalent changes made by using the contents of the present disclosure and appended drawings thereof are included within the scope of the present invention delineated by the following claims.

What is claimed is:

1. A dual-feed antenna, comprising:

a substrate, further comprising a first surface and a second surface opposite to the first surface;

a first antenna unit, further comprising a first radiating unit and a first grounding unit, which first radiating unit and first grounding unit being respectively formed on a first surface of the substrate; and a second antenna unit, further comprising a second radiating unit and a second grounding unit, which second radiating unit and second grounding unit are respectively formed on the first surface and a second surface of the substrate, and which second grounding unit is in proximity of the first grounding unit;

wherein the second radiating unit further comprises a second radiator which has a first groove including a first bottom and a pair of first arms; the second grounding unit consists of a first sub-grounding-area and a second sub-grounding-area, in which the second sub-grounding-area has a second groove including a second bottom and a pair of second arms, and in which the first sub-grounding-area is cross-wise connected with the second sub-grounding-area at the bottom of the groove, and the second arms symmetrically are distributed to both sides of the first sub-grounding-area; the first groove has an opening direction opposite to the opening direction of the second groove.

2. The dual-feed antenna according to claim 1, wherein the distance from the free end of the first arm to the free end of the second arm is approximately equal to one-half wavelength of a prescribed high frequency band.

3. The dual-feed antenna according to claim 2, wherein the vertical distance from the first bottom to the free end of the first arm is defined as the length of the second radiator, the vertical distance from the second bottom to the free end of the second arm is defined as the length of the second sub-grounding-area, and the length of the second radiator is approximately equal to the length of the second sub-grounding-area.

4. The dual-feed antenna according to claim 1, wherein the first groove is a U-shaped groove, V-shaped groove, right angle U-shaped groove or arc-shaped groove and the second groove is a U-shaped groove, V-shaped groove, right angle U-shaped groove or arc-shaped groove.

5. The dual-feed antenna according to claim 1, wherein the first sub-grounding-area is rectangular, circular or elliptic, and the size of the long side of the rectangle, the diameter of the circle or the long axis of the ellipse is greater than or equal to one-half wavelength of a prescribed high frequency band.

6. The dual-feed antenna according to claim 1, wherein the second radiating unit further consists of a microstrip transmission line, in which one end of the microstrip transmission line far from the second radiator is installed with a second feed point, and one end of the first sub-grounding-area corresponding to the second feed point is installed with a second grounding-point.

7. The dual-feed antenna according to claim 1, wherein the first radiating unit consists of a first radiator, the length of which first radiator being slightly smaller than one-quarter wavelength of a prescribed low frequency band.

8. The dual-feed antenna according to claim 7, wherein the first radiator is sinuously installed on the first surface of the substrate, in which one end of the first radiator close to the first grounding unit is provided with a first feed point, which first feed point being out of the range covered or projected from the first grounding unit onto the substrate.

9. The dual-feed antenna according to claim 7, wherein the first radiating unit further consists of a short circuit shred of L shape connecting the first radiator and the first grounding unit.

10. The dual-feed antenna according to claim 1, wherein the first grounding unit includes a first grounding-area and a first grounding-point, in which the first grounding-area is polygonal, circular or elliptic, and the size of the long side of the polygon, the diameter of the circle or the long axis of the ellipse is approximately equal to one-quarter wavelength of a prescribed low frequency band, and the first grounding-point is installed on the end of the first grounding-area close to the first radiator.

11. A dual-feed antenna, comprising:

a substrate, consisting of a first surface and a second surface opposite to the first surface;

a first antenna unit, consisting of a first radiating unit and a first grounding unit, which first radiating unit being formed on a first surface of the substrate and which first grounding unit formed on a second surface of the substrate, with a hole further provided on the substrate; and a second antenna unit, consisting of a second radiating unit and a second grounding unit, which second radiating unit and second grounding unit being respectively formed on the first surface and the second surface of the substrate, and which second grounding unit being in proximity of the first grounding unit;

wherein the second radiating unit consists of a second radiator which has a first groove including a first bottom and a pair of first arms; the second grounding unit consists of a first sub-grounding-area and a second sub-grounding-area, in which the second sub-grounding-area has a second groove including a second bottom and a pair of second arms, and in which the first sub-grounding-area is cross-wise connected with the second sub-grounding-area at the bottom of the groove, and the second arms symmetrically distribute to both sides of the first sub-grounding-area; the first groove has an opening direction opposite to the opening direction of the second groove.

12. The dual-feed antenna according to claim 11, wherein the distance from the free end of the first arm to the free end of the second arm is approximately equal to one-half wavelength of a prescribed high frequency band.

13. The dual-feed antenna according to claim 11, wherein the vertical distance from the first bottom to the free end of the first arm is defined as the length of the second radiator, the vertical distance from the second bottom to the free end of the second arm is defined as the length of the second sub-grounding-area, and the length of the second radiator is approximately equal to the length of the second sub-grounding-area.

14. The dual-feed antenna according to claim 11, wherein the first groove is a U-shaped groove, V-shaped groove, right angle U-shaped groove or arc-shaped groove and the second groove is a U-shaped groove, V-shaped groove, right angle U-shaped groove or arc-shaped groove.

15. The dual-feed antenna according to claim 11, wherein the first sub-grounding-area is rectangular, circular or elliptic, and the size of the long side of the rectangle, the diameter of the circle or the long axis of the ellipse is greater than or equal to one-half wavelength of a prescribed high frequency band.

16. The dual-feed antenna according to claim 11, wherein the second radiating unit further consists of a microstrip transmission line, in which one end of the microstrip transmission line far from the second radiator is installed with a second feed point, and one end of the first sub-grounding-area corresponding to the second feed point is installed with a second grounding-point.

17. The dual-feed antenna according to claim 11, wherein the first radiating unit consists of a first radiator, the length of which first radiator being slightly smaller than one-quarter wavelength of a prescribed low frequency band.

18. The dual-feed antenna according to claim 17, wherein the first radiator is sinuously installed on the first surface of the substrate, in which one end of the first radiator close to the first grounding unit is provided with a first feed point, which first feed point being out of the range covered or projected from the first grounding unit onto the substrate.

19. The dual-feed antenna according to claim 17, wherein the first radiating unit further consists of a short circuit shred of L shape connecting the first radiator and the first grounding unit.

20. The dual-feed antenna according to claim 11, wherein the first grounding unit includes a first grounding-area and a first grounding-point, in which the first grounding-area is polygonal, circular or elliptic, and the size of the long side of the polygon, the diameter of the circle or the long axis of the ellipse is approximately equal to one-quarter wavelength of a prescribed low frequency band, and the first grounding-point is installed on the end of the first grounding-area close to the first radiator.

* * * * *